US007354290B2

(12) United States Patent
Zhan et al.

(10) Patent No.: US 7,354,290 B2
(45) Date of Patent: Apr. 8, 2008

(54) SURFACE CONTACT CARD HOLDER

(75) Inventors: Zi-Gang Zhan, Shenzhen (CN); Chia-Hua Chen, Taipei Hsien (TW)

(73) Assignees: Shenzhen Futaihong Precision Industry Co., Ltd., Shenzhen, Guangdong Province (CN); Sutech Trading Limited, Tortola (VG)

( * ) Notice: Subject to any disclaimer, the term of this patent is extended or adjusted under 35 U.S.C. 154(b) by 0 days.

(21) Appl. No.: 11/616,826

(22) Filed: Dec. 27, 2006

(65) Prior Publication Data

US 2007/0224871 A1 Sep. 27, 2007

(30) Foreign Application Priority Data

Mar. 23, 2006 (CN) ..... 200610034655.6

(51) Int. Cl.
*H01R 13/62* (2006.01)

(52) U.S. Cl. ..... 439/326; 439/630; 439/923

(58) Field of Classification Search ..... 439/326–328, 439/630, 923

See application file for complete search history.

(56) References Cited

U.S. PATENT DOCUMENTS 6,193,557 B1 * 2/2001 Luvini et al. ..... 439/630

* cited by examiner

*Primary Examiner*—Javaid H. Nasri
(74) *Attorney, Agent, or Firm*—Jeffrey T. Knapp

(57) ABSTRACT

A surface contact card holder (8) includes a body (10) and a receiving mechanism (20). The receiving mechanism has two sidewalls (21), an elastic member (26), a holding wall (27), and a holding piece (25). The sidewalls, the elastic member, and the holding wall are provided on the body. The holding piece is formed on the holding wall. The elastic member and the holding wall cooperate to hold a surface contact card in a first direction. The two sidewalls cooperate to hold the surface contact card in a second direction. The holding piece and the body cooperate to hold the surface contact card in a third direction. The elastic member can be pressed in the first direction.

13 Claims, 6 Drawing Sheets

SURFACE CONTACT CARD HOLDER

BACKGROUND OF THE INVENTION

1. Field of the Invention

The present invention generally relates to mechanisms for holding card members in electronic devices and, particularly, to a surface contact card holder configured (i.e., structured and arranged) for holding a surface contact card in a portable electronic device.

2. Description of Related Art

With the development of wireless communication and information processing technologies, portable electronic devices such as mobile phones are now in widespread use. These electronic devices enable consumers to enjoy high-tech services anytime and anywhere. Surface contact cards having special circuits are widely used in portable electronic devices to enhance or specialize the functions of the portable electronic devices. For example, a subscriber identity module (SIM) card can be placed in a mobile phone to dedicate the mobile phone' functions to the SIM card owner. By changing SIM cards, a single mobile phone can be used by many different SIM card owners as a personal phone.

Referring now to FIG. 6, a conventional mechanism for holding a SIM card therein includes a base 92 and a holding structure 94. The base 92 defines a receiving recess 921. A SIM connector 90 having a plurality of contacts is set in a middle of the receiving recess 921. The shape and size of the receiving recess 921 are the same as those of the SIM card. The holding structure 94 is located adjacent to one end of the receiving recess 921 and can be moved back and forth along a direction as indicated by the arrow shown in FIG. 6.

In use, firstly, the holding structure 94 is moved away from the receiving recess 921 and the SIM card is inserted into the receiving recess 921. Then, the holding structure 94 is moved adjacent to the receiving recess 921 so as to latch the SIM card in the receiving recess 921. In the same way, the SIM card can be released by moving the holding structure 94 away from the receiving recess 921.

In the above conventional mechanism for holding a SIM card, the holding structure 94 can be easily moved so that it is convenient for a user to operate. However, when a mobile phone employing such a mechanism for holding a SIM card drops to ground, shock can easily force the holding structure 94 to move off the receiving recess 921. As a result, the SIM card will not connect well with the SIM contactor 90 and may even be released from the receiving recess 921. Obviously, such a conventional mechanism cannot hold the SIM card steadily in the receiving recess 921.

Therefore, there is a need for a new surface contact card holder which can hold a surface contact card steadily in a portable electronic device.

SUMMARY

In one embodiment thereof, a surface contact card holder includes a body and a receiving mechanism. The receiving mechanism has two sidewalls, an elastic member, a holding wall, and a holding piece. The sidewalls, the elastic member, and the holding wall are provided on the body. The holding piece is formed on one of the elastic member and the holding wall. The elastic member and the holding wall cooperate to hold a surface contact card in a first direction. The two sidewalls cooperate to hold the surface contact card in a second direction. The holding piece and the body cooperate to hold the surface contact card in a third direction. The elastic member can be pressed in the first direction.

Other advantages and novel features of the embodiments will become more apparent from the following detailed description thereof when taken in conjunction with the accompanying drawings.

BRIEF DESCRIPTION OF THE DRAWINGS

Many aspects of the surface contact card holder can be better understood with reference to the following drawings. The components in the drawings are not necessarily drawn to scale, the emphasis instead being placed upon clearly illustrating the principles of the present surface contact card holder. Moreover, in the drawings, like reference numerals designate corresponding parts throughout the several views.

DETAILED DESCRIPTION OF THE EMBODIMENTS

Figure 1:
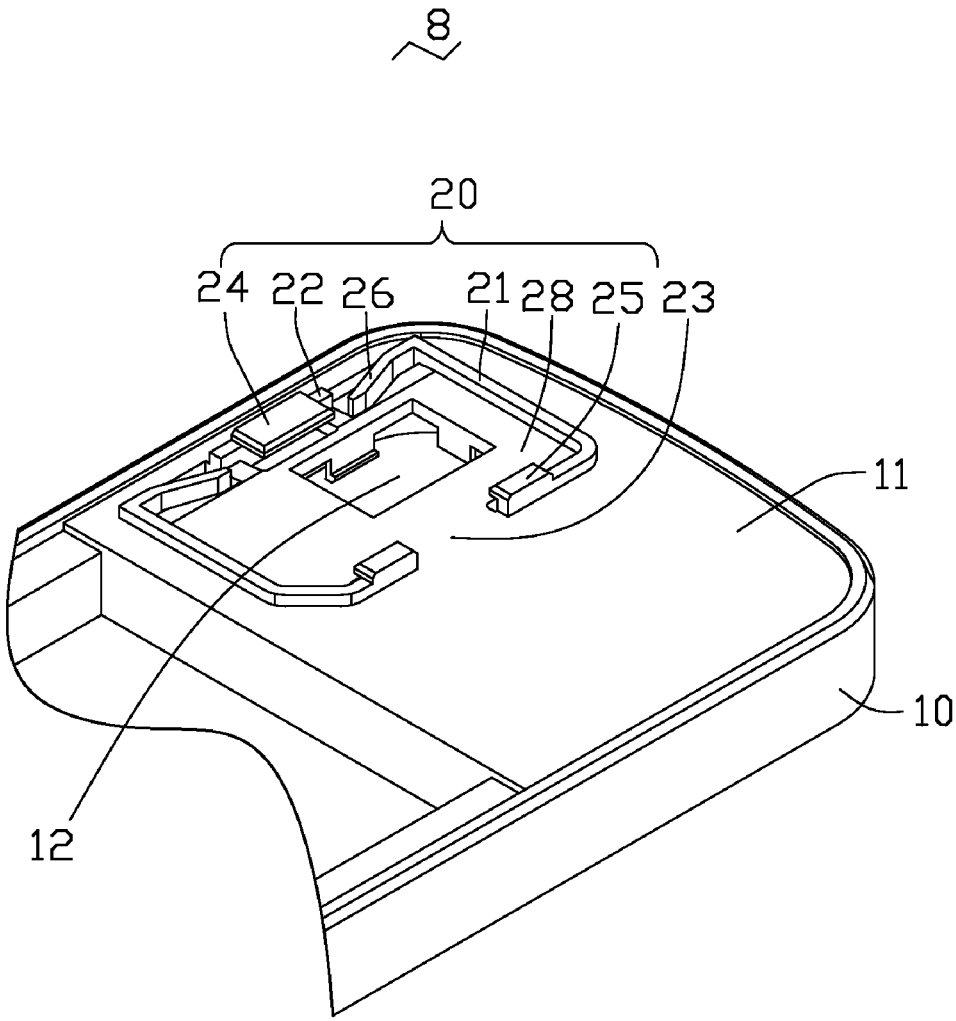
FIG. 1 is an isometric view of a surface contact card holder in accordance with a preferred embodiment.
Figure 4:
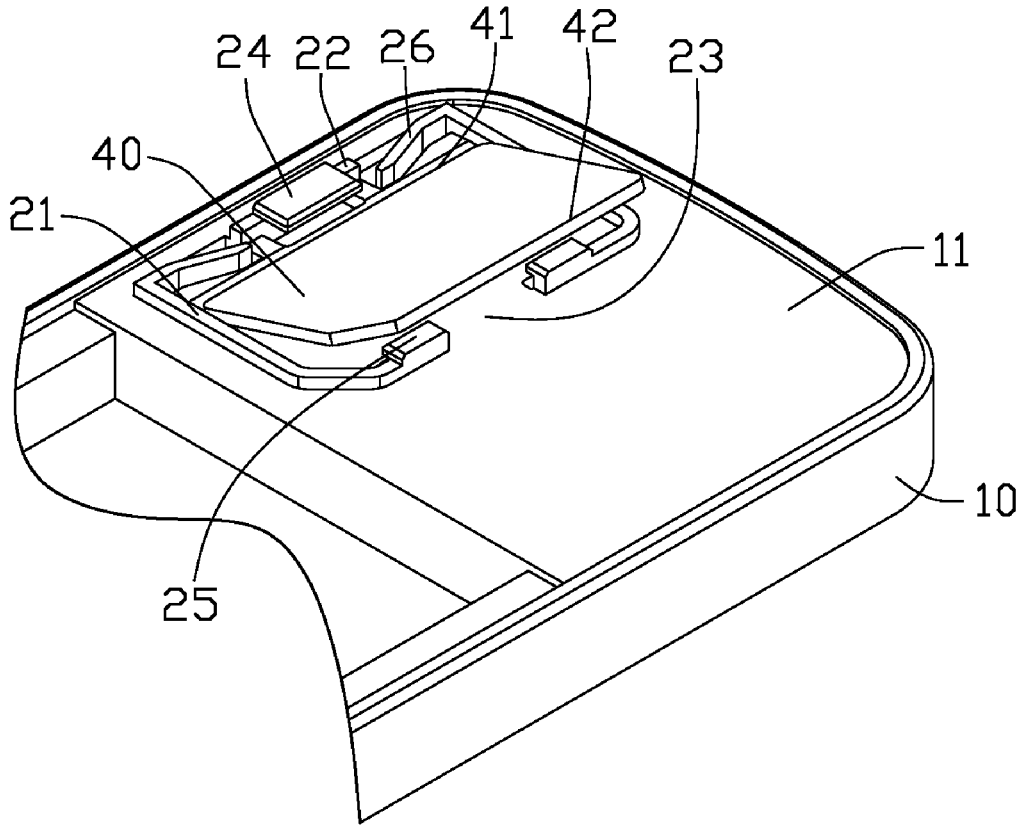
FIG. 4 is an isometric view of the surface contact card holder, the connector, and a surface contact card, showing the surface contact card in a first position.
Figure 5:
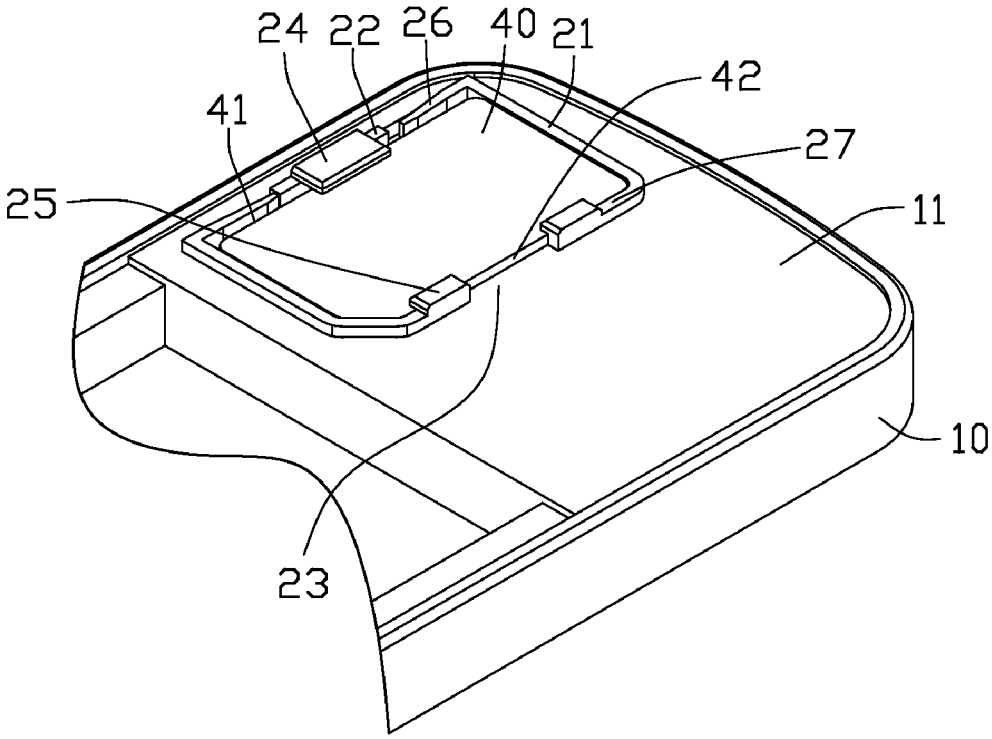
FIG. 5 is similar to FIG. 4 but showing the surface contact card in a second position.
Figure 6:
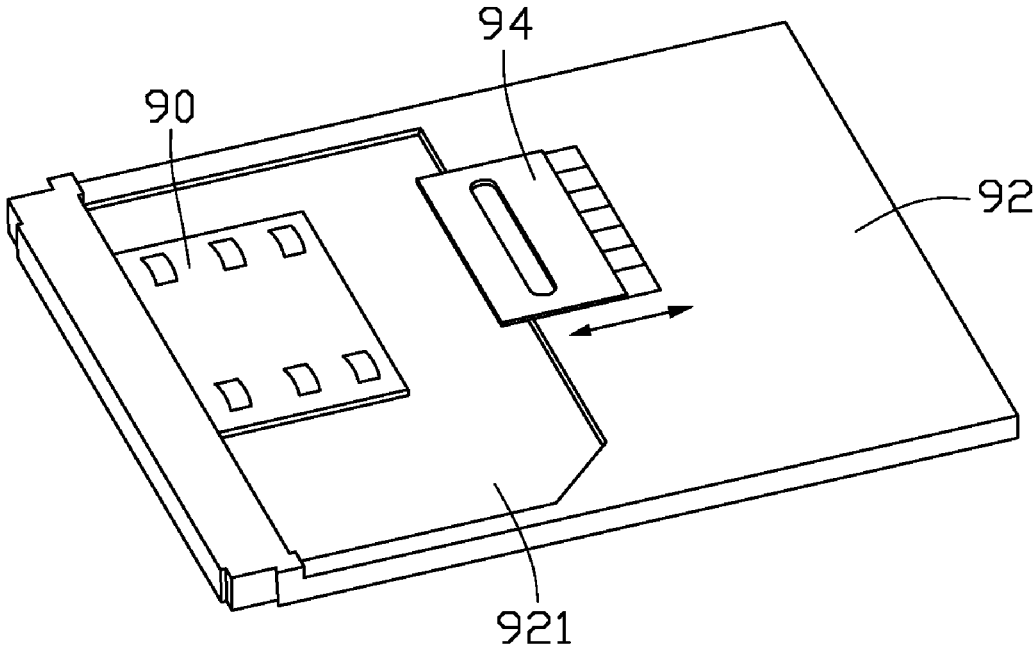
FIG. 6 (RELATED ART)
FIG. 6 is an isometric view of a conventional SIM card holder.

The present surface contact card holder can be used for holding surface contact cards such as SIM cards, compact flash cards (CFs), multimedia cards (MMCs), and so on. In a preferred embodiment of the present surface contact card holder, FIGS. 1 and 4-5 show a surface contact card holder 8 for holding a SIM card 40 therein. The SIM card 40 has a first end 41 and a second end 42. The first end 41 is opposed to the second end 42. The surface contact card holder 8 includes a body 10 and a receiving mechanism 20. The body 10 is a substantially rectangular board in shape and has a body surface 11 at one side thereof.

Further referring to FIGS. 1 and 5, the receiving mechanism 20 is provided at the body surface 11 of the body 10. The receiving mechanism 20 is configured for receiving the SIM card 40 therein. The receiving mechanism 20 includes a pair of sidewalls 21 and a positioning wall 22. Each of the sidewall 21 is a substantially U-shaped strip in shape, and has a first arm 26 and a second arm 27 directly formed at two opposite ends of the sidewall 21 and extending toward the other sidewall 21. The first arms 26 are made of an elastic material. The two sidewalls 21 are symmetrically arranged with each other about a line. The positioning wall 22 is a substantially strip in shape and is located between the two first arms 26. The positioning wall 22 is substantially parallel to the second arms 27. Two adjacent ends of the second arms 27 together define an opening 23 therebetween.

A distal end of each first arm 26 is bent towards the second arm 27. A holding piece 25 extends perpendicularly from the second arm 27 of each sidewall 21 and towards the positioning wall 22. Each holding piece 25 is a substantially rectangular board in shape. A positioning piece 24 extends perpendicularly from the positioning wall 22 and towards the second arm 27. The two sidewalls 21, the two holding pieces 25, the positioning wall 22, the positioning piece 24, and the body 10 cooperate to define a receiving groove 28. The receiving groove 28 is a receiving space surrounded by the side walls 21 and the positioning piece 24 and configured for receiving the SIM card 40 therein. The positioning piece 24 is made of an elastic material.

Figure 2:
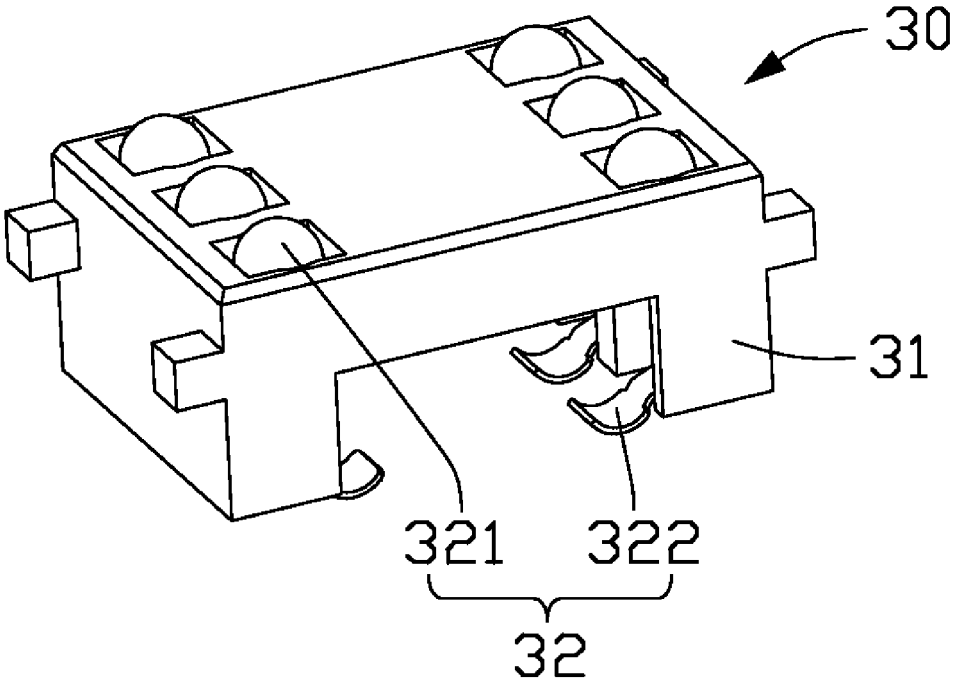
FIG. 2 is an isometric view of a connector used with the surface contact card holder in FIG. 1.
Figure 3:
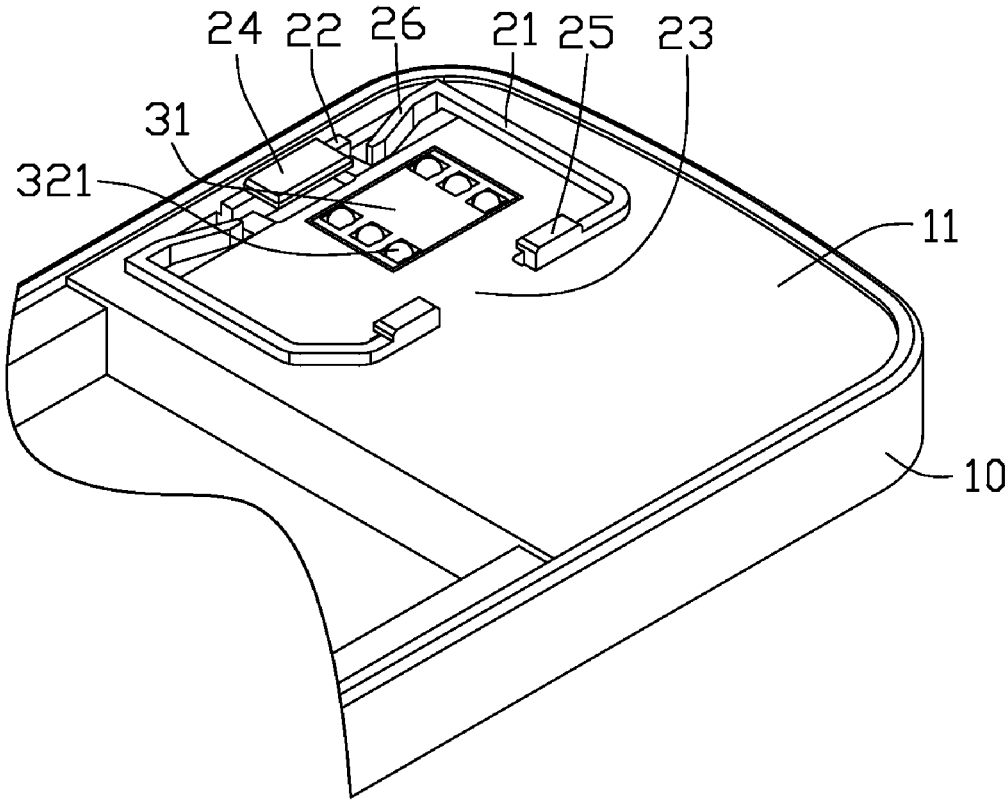
FIG. 3 is an isometric, assembled view of the surface contact card holder and the connector.

Also referring to FIGS. 2-3, a SIM connector 30 having a plurality of contacts 32 is provided in the body 10. Each contact 32 includes a top contact 321 and a bottom contact 322. The top contact 321 and the bottom contact 322 of each contact 32 are electrically connected to each other. The body 10 defines a through hole 12 therethrough. The hole 12 communicates with the receiving groove 28. The SIM connector 30 is configured for receipt in the through hole 12 allowing the top contacts 321 to be exposed out of the body surface 11. When the SIM card 40 is inserted into the receiving groove 28, the SIM card 40 is electronically connected with the top contacts 321 of the SIM connector 30. The bottom contacts 322 are electronically connected with a processor (not shown) in the body 10 so that the SIM connector 30 transfers the information in the SIM card 40 to the processor.

Also referring to FIG. 4, in use, to mount the SIM card 40 with the body 10, the first end 41 of the SIM card 40 is inserted between the positioning piece 24 and the body surface 11 of the body 10. Now the SIM card 40 is located in a first position. Then the SIM card 40 is pushed towards the positioning wall 22. In this process, the first arms 26 are pressed to move away from the second arms 27 and a force is collected. The second end 42 of the SIM card 40 slides relative to the holding pieces 25. After the second end 42 slides over the holding pieces 25, the SIM card 40 is pressed downwardly towards the body surface 11. Then the SIM card 40 is pushed to abut with the second arms 27 due to the force produced by the first arms 26 and the first arms 26 go back to their original position. Thus the SIM card 40 is mounted into the receiving groove 28 of the body 10, as shown in FIG. 5. Now the SIM card 40 is located in a second position.

It is to be understood that in the second position the first arms 26 can be slightly pressed by the SIM card 40 and the second arms 27. The first arms 26 and the second arms 27 cooperate to hold the SIM card 40 in a first direction parallel to the SIM card 40. The two sidewalls 21 cooperate to hold the SIM card 40 in a second direction parallel to the SIM card 40 and perpendicular to the first direction. The positioning piece 24, the holding pieces 25, and the body 10 cooperate to hold the SIM card 40 in a third direction perpendicular to the SIM card 40. The first, second, and third directions are perpendicular to each other.

To remove the SIM card 40, the SIM card 40 is pushed toward the positioning wall 22 by pushing the second end 42 through the opening 23. In this process, the first arms 26 are pressed to move away from the second arms 27 and the force is collected. The second end 42 of the SIM card 40 slides relative to the holding pieces 25. After the second end 42 slides over the holding pieces 25, the SIM card 40 can be upwardly removed.

It is to be understood that one sidewall may only be a linear strip and be perpendicular to the second arm of another sidewall. The first arms 26 may be directly formed on the body 11 and be separate from the sidewalls 21. Alternatively, the first arms 26 may be directly formed on the positioning wall 22. In another embodiment, the first arms 26 may be another type of elastic member such as a spring. The spring may be mounted to the positioning wall 22 and can cooperate with the second arms 27 to hold the SIM card 40 in the first direction. The second arms 27 may be another holding wall directly formed on the body 11 and be separate from the sidewalls 21.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A surface contact card holder comprising:

a body; and a receiving mechanism having two sidewalls, an elastic member, a holding wall, and a holding piece, the sidewalls, the elastic member, and the holding wall being provided on the body, and the holding piece being formed on one of the elastic member and the holding wall;

wherein the elastic member and the holding wall cooperate to hold a surface contact card in a first direction, the two sidewalls cooperate to hold the surface contact card in a second direction, the holding piece and the body cooperate to hold the surface contact card in a third direction, and the elastic member can be pressed in the first direction.

2. The surface contact card holder as claimed in claim 1, wherein the first, second, and third directions are perpendicular to each other.

3. The surface contact card holder as claimed in claim 1, wherein when the surface contact card is mounted in the surface contact card holder, the elastic member is able to be pressed to move by pushing the surface contact card.

4. The surface contact card holder as claimed in claim 1, wherein the receiving mechanism further includes a positioning wall, the positioning wall is substantially parallel to the holding wall.

5. The surface contact card holder as claimed in claim 4, wherein a positioning piece extends perpendicularly from the positioning wall and towards the holding wall.

6. The surface contact card holder as claimed in claim 4, wherein the elastic member is formed on the positioning wall.

7. The surface contact card holder as claimed in claim 1, wherein the elastic member and the holding wall are formed at two opposite ends of one sidewall, the elastic member is a substantially strip in shape, and a distal end of the elastic member is bent towards the holding wall.

8. The surface contact card holder as claimed in claim 7, wherein the sidewall having the elastic member and the holding wall formed thereat has a substantially U-shaped form.

9. The surface contact card holder as claimed in claim 7, wherein the other sidewall includes an elastic member and an holding wall formed at two opposite ends thereof and a distal end of the elastic member of the other sidewall is bent towards the holding wall of the other sidewall.

10. The surface contact card holder as claimed in claim 9, wherein the two holding walls together define an opening therebetween.

11. The surface contact card holder as claimed in claim 9 wherein the other sidewall is substantially U-shaped.

12. A surface contact card holder comprising:

a body comprising a surface and a hole defined in the surface configured for receiving a connector therein; and a receiving mechanism comprising a pair of sidewalls fixed on the surface of the body at opposite sides of the hole, each of the sidewalls comprising a main portion fixed on the surface of the body and extending in a first direction, a holding portion extending from one end of the main portion toward the other sidewall in a second direction and fixed on the body, and a free portion extending from an opposite end of the main portion toward the other side wall in a direction nonparallel to the second direction and being deformable in the first direction, a holding piece being formed at one of the holding portions and another holding piece being arranged adjacent the free portions;

wherein the sidewalls cooperatively define therebetween a receiving space communicating with the hole for holding a surface contact card in such a manner that the free portions and the holding portions cooperate to sandwich the surface contact card therebetween in the first direction with the free portions being deformed and abutting against the surface contact card toward the holding portion, the main portions of the sidewalls cooperate to sandwich the surface contact card therebetween in a second direction, the holding pieces press opposite side edges of the surface contact card toward the surface of the body in a third direction.

13. The surface contact card holder as claimed in claim 12, wherein a positioning wall is fixed on the surface between the free portions of the sidewalls, said another holding piece extending perpendicularly from the positioning wall toward the receiving space.

* * * * *